US005363763A

United States Patent [19]

Fiore

[11] Patent Number: 5,363,763

[45] Date of Patent: Nov. 15, 1994

[54] INKER MECHANISM

[75] Inventor: Allan Fiore, Randolph, N.J.

[73] Assignee: Fury, Ltd., Cedar Knolls, N.J.

[21] Appl. No.: 120,053

[22] Filed: Sep. 13, 1993

[51] Int. Cl.[5] ..... B41F 31/14; B41F 31/26

[52] U.S. Cl. ..... 101/349; 101/DIG. 38

[58] Field of Search ..... 101/DIG. 38, 148, 348, 101/349, 350, 351, 352, 207–210

[56] References Cited

U.S. PATENT DOCUMENTS

| | | | |
|---|---|---|---|
| 4,040,347 | 8/1977 | Johne et al. | 101/349 |
| 4,458,592 | 7/1984 | Junghans | 101/349 |
| 4,513,663 | 4/1985 | Hummel et al. | 101/349 |
| 4,658,724 | 4/1987 | Beisel et al. | 101/351 |
| 4,838,163 | 6/1989 | Jeschke et al. | 101/349 |
| 5,060,568 | 10/1991 | Jentzsch et al. | 101/148 |
| 5,103,726 | 4/1992 | Wieland | 101/349 |

FOREIGN PATENT DOCUMENTS

| | | | |
|---|---|---|---|
| 237644 | 10/1986 | Japan | 101/DIG. 38 |
| 331938 | 7/1930 | United Kingdom | 101/DIG. 38 |

*Primary Examiner*—J. Reed Fisher

*Attorney, Agent, or Firm*—Thomas L. Adams

[57] ABSTRACT

An inker mechanism has an inking roller rotatably mounted on a frame. The inking roller has a degree of freedom allowing the roller to shift axially. A bearing assembly is coaxially connected to the roller for axially shifting the roller. This bearing assembly has an outer shell with a universal joint. The inker mechanism also has a cam and a pivotally mounted lever connected between this cam and the universal joint. This cam can articulate the lever to oscillate the roller axially.

15 Claims, 5 Drawing Sheets

INKER MECHANISM

BACKGROUND OF THE INVENTION

1. Field of the Invention

The present invention relates to inker mechanisms having inking rollers for delivering ink to a printing process, and in particular, to rollers that are axially oscillated to evenly distribute ink.

2. Description of Related Art

In a known press, such as a dry offset press, a plate wrapped around a plate cylinder is embossed with the image of a color separation. The plate can deposit an ink pattern on the surface of a blanket cylinder. The blanket cylinder can imprint the ink on paper, a beverage can, or other articles. Several such plate cylinders may be arranged around the circumference of the blanket cylinder to achieve multiple color printing.

Known mechanisms for delivering ink to the blanket cylinder have employed a series of steel inking rollers. Ink is passed between these rollers by intervening, resilient, transfer rollers. The first steel roller is a fountain roller that is partially immersed in an ink reservoir. Downstream from the last steel roller, transfer rollers can convey ink directly to the plate cylinder that inks the blanket cylinder.

An important consideration in ink delivery is keeping the ink evenly distributed. Even if the mechanism for delivering ink is highly precise, uneven distribution occurs whereby relatively dry regions propagate upstream due to the depletion of ink from the downstream inking rollers in accordance with the image being printed. Without taking further steps, the repetitive removal of ink at the same angular position will tend to keep the inking rollers dry precisely at the positions where ink is needed.

To deal with this problem, known inking rollers have been mounted in frames to allow them to shift axially. This shifting prevents the ink depletion from occurring at the same position on each revolution of the inking rollers, thereby enhancing even ink distribution.

In U.S. Pat. No. 5,060,568, one end of a lever follows a track formed in a rotary cam. The other end of the lever has a wheel that rides between a pair of discs mounted on the shaft of an axially shiftable inking roller. This wheel however, tends to spin at about the same rate as the inking roller, typically one to two thousand RPM. Wear is a problem and the bearing for the wheel that shifts the inking roller needs frequent replacement.

U.S. Pat. No. 5,103,726 shows another inking roller that is axially oscillated by a lever. The lever acts through a pivoting bearing to axially oscillate a gear driven bushing. The bushing connects through a universal joint to the shaft of an inking roller. This universal allows for lifting of the inking roller off the plate cylinder. This structure however, does not avoid wear at the connection between the lever and the inking roller. The universal joint and the pivoting bearing spin at the same speed as the inking roller. See also U.S. Pat. Nos. 4,040,347; 4,513,663; 4,658,724; and 4,838,163.

Accordingly, there is a need for an inker mechanism that has an improved link to the oscillating inking roller.

SUMMARY OF THE INVENTION

In accordance with the illustrative embodiments, demonstrating features and advantages of the present invention there is provided an inker mechanism having a frame and an inking roller rotatably mounted on the frame with freedom to shift axially at least a predetermined amount. The mechanism has a bearing assembly connected coaxially to the roller. This bearing assembly has a coaxial outer shell with a compliant joint. The inking roller is mounted for rotation independently of the outer shell. The mechanism also has a pivotally mounted lever connecting to the compliant joint. This lever is operable to swing and to oscillate axially the roller. The compliant joint has a degree of freedom to accommodate swinging of the lever. The mechanism also has a drive means for swinging the lever.

By employing an inker mechanism of the foregoing type, a relatively efficient mechanism is achieved exhibiting reduced wear. In one preferred embodiment, a lever is pivotally mounted between two inking rollers and has a driven arm connected to a driving cam. The driving arm of the lever connects through a universal joint to a collar or shell that encircles the shaft of the inking roller. Mounted inside the shell is a conventional set of roller bearings allowing relative rotation between the shell and the shaft of the inking roller. Preferably, the lever connects to the shell through a Uniball bearing.

Since the lever axis is preferably perpendicular to the roller axis, the lever end will have components of motion that are parallel and perpendicular to the roller axis (i.e. axial and radial). Thus as the swinging lever rotates, it causes the shell to translate axially and also rotate about its axis as well. The universal joint can accommodate the rotation of the shell as the lever rotates.

Also because the driving end of the lever has a radial component of motion, the lever to roller spacing changes. Accordingly, the preferred universal joint also has additional freedom of motion to allow for elongation of the joint.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
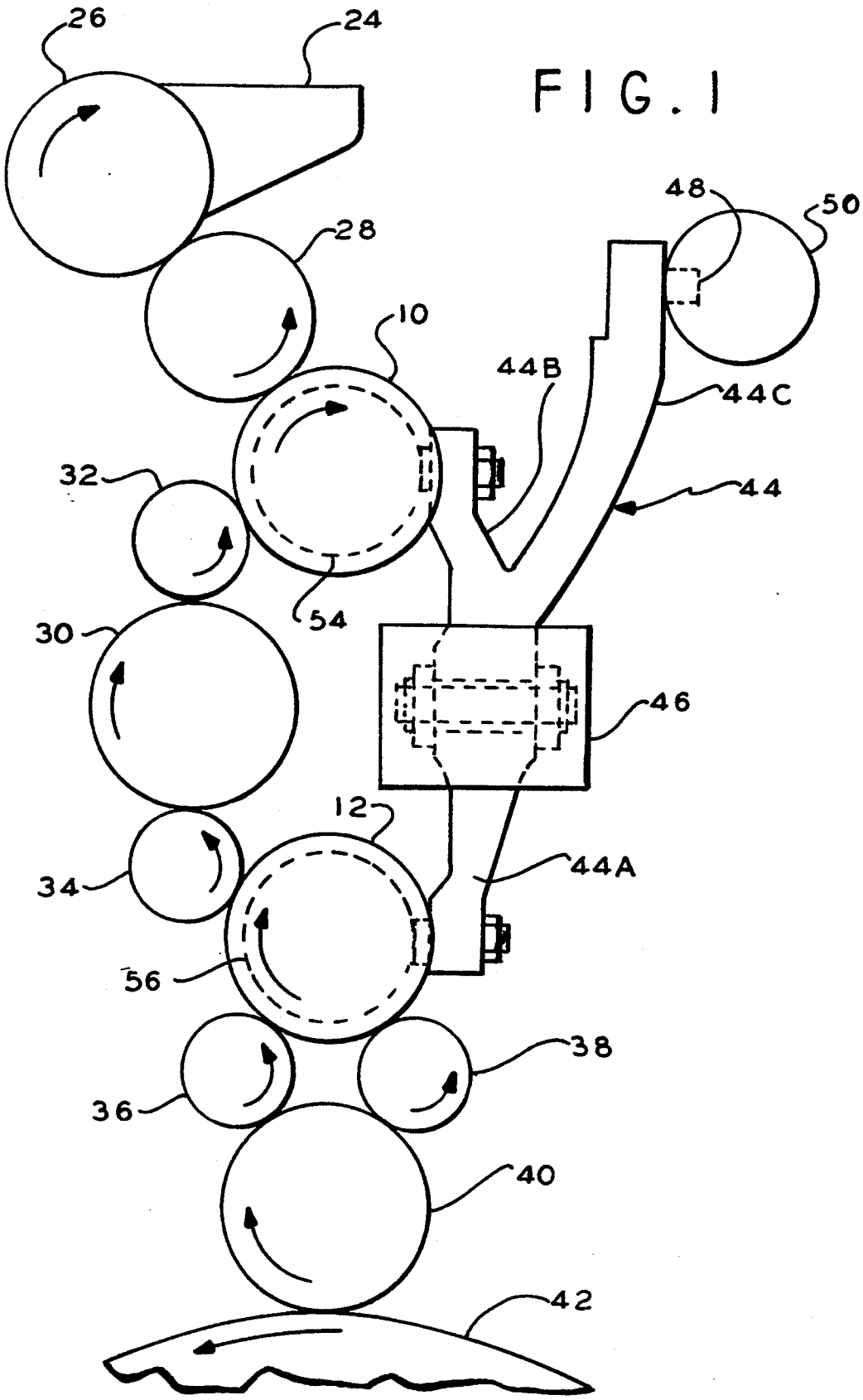
FIG. 1 is a schematic, axial view of an inker mechanism in accordance with the principles of the present invention.
Figure 2:
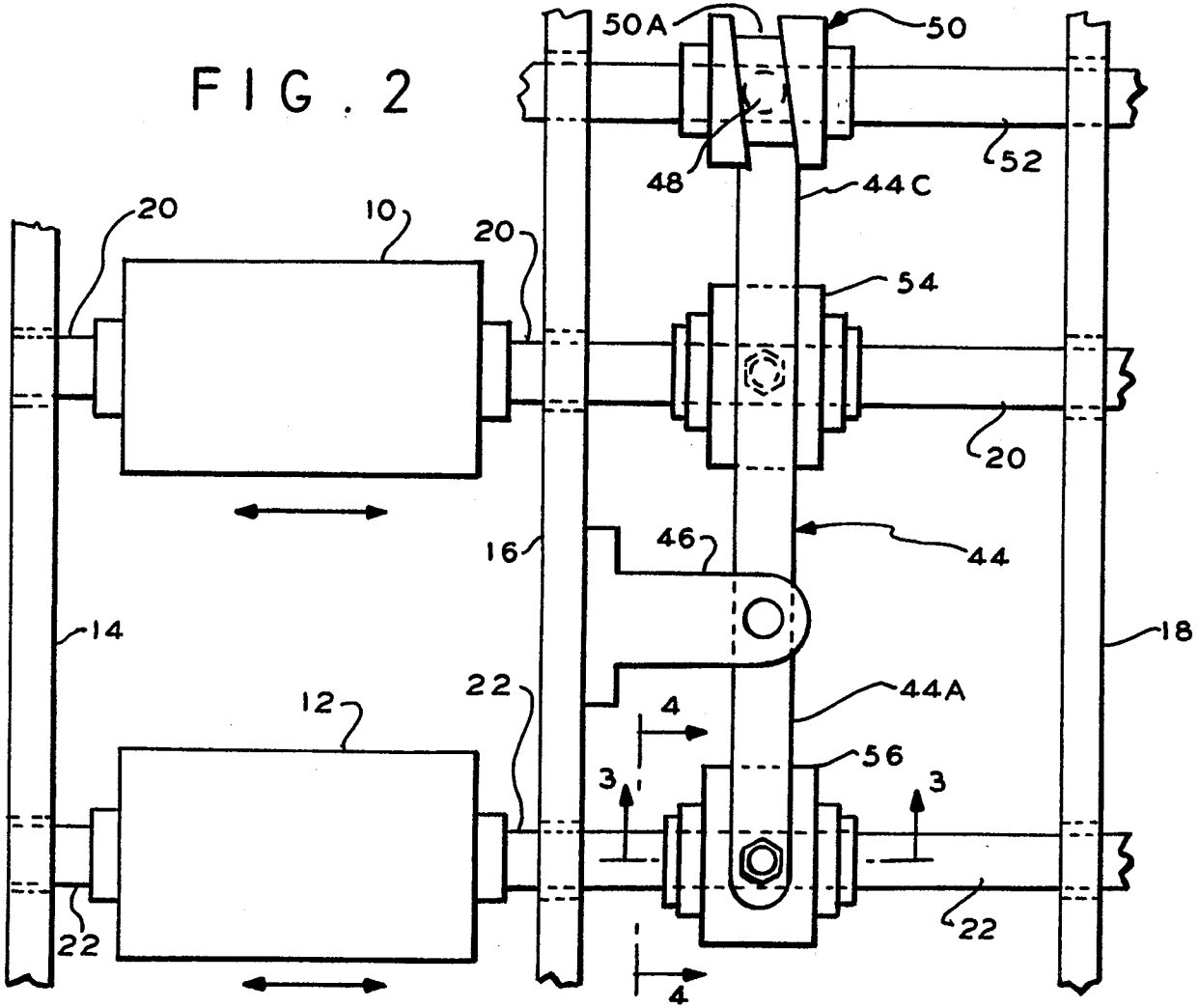
FIG. 2 is a side view taken along the right side of the inker mechanism of FIG. 1.

Referring to FIGS. 1 and 2, steel inking roller 10 has a shaft 20 that is journaled in frames 14, 16 and 18. Similarly, steel inking roller 12 has a shaft 22 similarly journaled in frames 14, 16 and 18. Shafts 20 and 22 are so mounted in frames 14, 16 and 18 as to be able to axially shift at least by a predetermined amount. Inking rollers 10 and 12 are part of a series of rollers that pass ink from a supply means, shown herein as ink reservoir 24. Reservoir 24 is a tray with a slanted floor for feeding ink to the periphery of a fountain roller 26.

Resilient transfer roller 28 rolls between rollers 26 and 10 to transfer ink. Another inking roller 30 is rotatably mounted between rollers 10 and 12. Resilient transfer roller 32 is rotatably mounted between rollers 10 and 30, while resilient transfer roller 34 is rotatably mounted between rollers 30 and 12. Two additional resilient transfer rollers 36 and 38 are rotatably mounted below steel inking roller 12, spaced about 60° apart.

Rollers 36 and 38 roll against a plate cylinder 40, which has on its periphery an inking plate having embossments that provide a positive of the image to be printed. Plate cylinder 40 rolls against the blanket cylinder 42. The object to be printed is pressed against the resilient surface of blanket cylinder 42. For example, beverage cans can be held against blanket cylinder 42 by an automatic feeder (not shown) that delivers cans on mandrels (not shown).

The inker mechanism of FIGS. 1 and 2 may be one of several inker mechanisms for delivering complementary images of different colors to provide multiple color printing. These separate inker mechanisms can be positioned at positions angularly spaced from that of the inker mechanism of FIG. 1.

Lever 44 is shown with three arms 44A, 44B and 44C. Lever 44 is pivotally mounted on journal 46, which is mounted on frame 16. Arms 44B and 44C are on one side of journal 46, while arm 44A is on the opposite side. Cam follower 48 mounted on the end of arm 44C rides inside track 50A of cam 50. Track 50A is bordered by sinuous sidewalls. Shaft 52 supports cam 50, and is journaled between frames 16 and 18. Shaft 52 may be driven through a reducing gear train, powered, for example, from either shaft 20 or 22 to rotate at about 1/10 of their speed.

Separately mounted around shafts 20 and 22 are bearing assemblies 54 and 56. The outer shells of bearings 54 and 56 connect to the ends of arms 44B and 44A, respectively.

Figure 3:
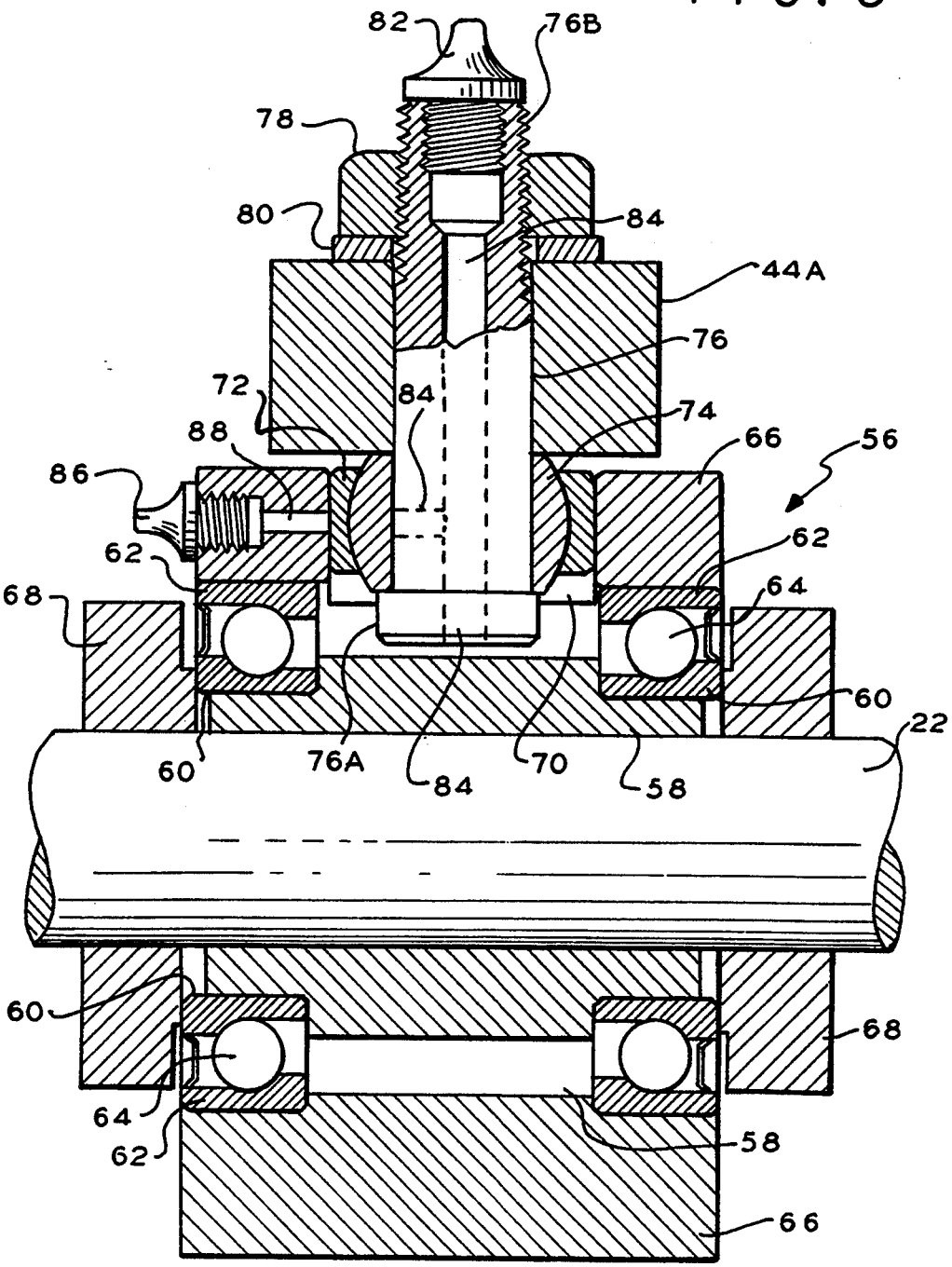
FIG. 3 is a detailed cross-sectional view of the bearing assembly of FIG. 2 taken along line 3—3 of FIG. 2.
Figure 4:
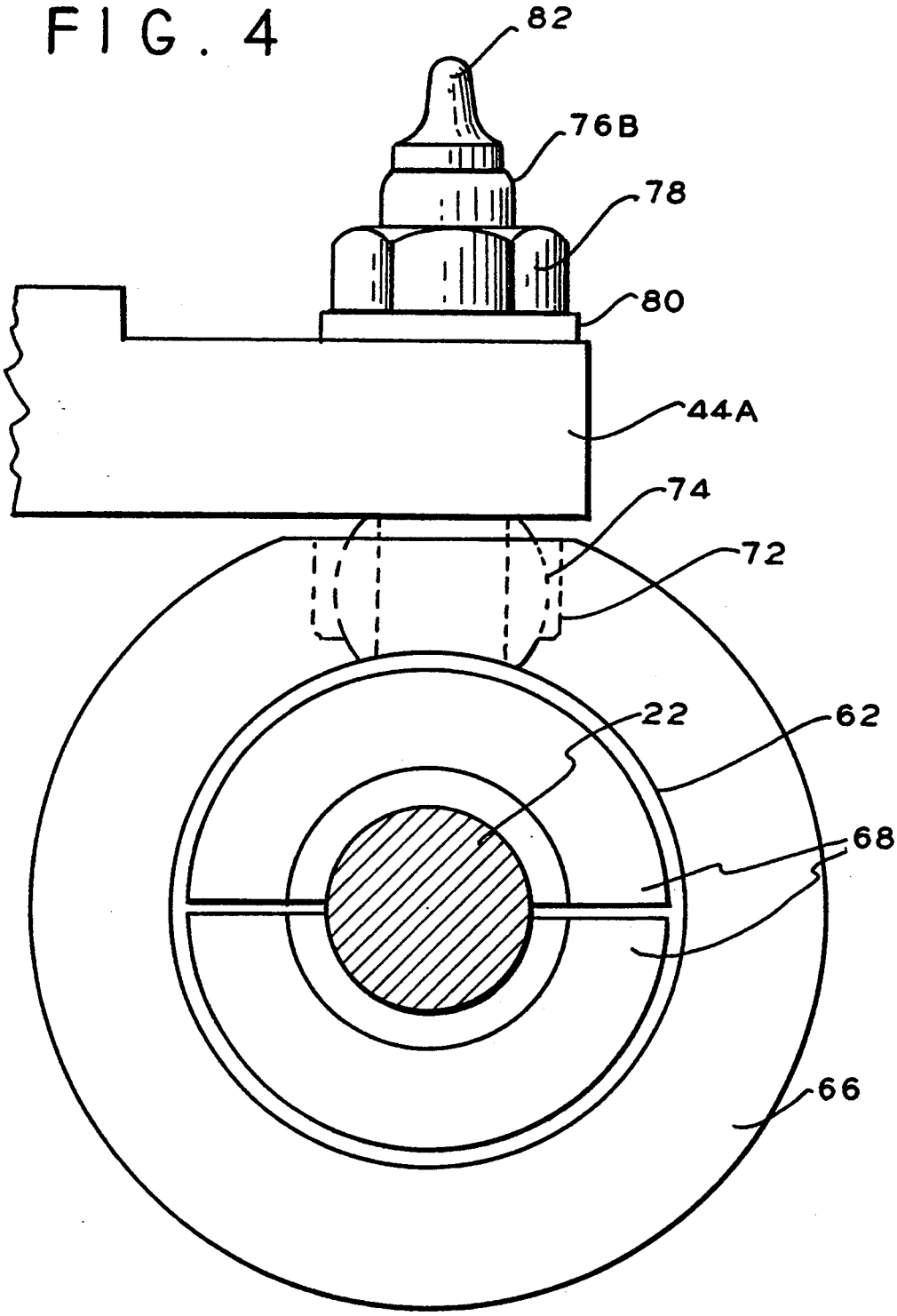
FIG. 4 is a detailed view of the bearing assembly taken along line 4—4 of FIG. 2.

Referring to FIGS. 3 and 4, bearing assembly 56 is shown in detail (bearing assembly 54 has a similar structure and appearance). Snuggly fitted around previously illustrated shaft 22 is a sleeve 58 having a cylindrical inner and outer surface. Both ends of sleeve 58 have a reduced outside diameter for holding a pair of bearings having an inner bearing race 60 and an outer bearing race 62 embracing rolling elements 64.

An outer shell 66 surrounds bearings 60, 62, 64 and has, for the most part, a cylindrical outside and inside surface. The ends of shell 66 have an increased inside diameter sized to fit outer race 62. Bearings 60, 62, 64 are held in place on shaft 22 by a pair of split collars 68, also referred to as a clamp means. Collars 68 may be bolted together to clamp on shaft 22 in the usual fashion.

Mounted in a cylindrical bore 70 of outer shell 66 is a compliant joint, shown herein as a universal comprising socket 72 encircling annulus 74. Members 72 and 74 may be a Uniball-type universal joint, providing two rotational degrees of freedom (although one degree may be adequate for some embodiments). Optionally, the inside surface of socket 72 may have a liner formed of bronze or other material to facilitate rotation between members 72 and 74. Socket 72 has a cylindrical outside periphery and a frusto-spherical inside surface. Annular member 74 is frusto-spherical member having a cylindrical bore for holding stud 76. Stud 76 has a threaded end 76B and an enlarged head 76A to keep stud 76 from pulling out of annulus 74. Nut 78 secures onto stud 76: washer 80, lever arm 44A and frusto-spherical member 74.

Threaded into end 76B of stud 76 is a grease fitting 82, communicating with bore 84, which feeds into the space between sleeve 58 and shell 66 to lubricate rolling elements 64. Another grease fitting 86 communicates with bore 88 to lubricate the surface between socket 72 and shell 66.

To facilitate an understanding of the principles associated with the foregoing apparatus, its operation will be briefly described in connection with the foregoing figures and FIGS. 5A and 5B.

Ink in reservoir 24 is deposited on the outside of fountain roller 26 as it rotates clockwise. Rollers 26–38, rollers 10, 12 as well as cylinders 40 and 42 may be geared to rotate synchronously so there is no slipping between the mating surfaces of the rollers. In some embodiments, however, fountain roller 26 and transfer roller 28 may operate at different speeds or in different directions to cause roller 28 to operate as a grinding roller. Ink from fountain roller 26 is transferred to the following rollers in the following sequence: rollers 28, 10, 32, 30, 34, and 12. Thereafter inking roller 12 passes ink simultaneously to transfer rollers 36 and 38. Rollers 36 and 38 simultaneously transfer ink to plate cylinder 40, which then deposits an image on blanket cylinder 42.

By depositing a positive image on blanket cylinder 42, plate cylinder 40 depletes, in turn, ink from transfer rollers 36 and 38 to produce on them a negative image or ghost. This ghosting causes a negative image to propagate upstream through the rollers.

To minimize this ghosting, inking rollers 10 and 12 are axially oscillated as follows: Shaft 52 (FIG. 2) is rotated at about 1/10 the speed of shafts 20 and 22. Consequently, cam 50 rotates relatively slowly to oscillate cam follower 48 and lever 44. Lever 44 oscillates bearings 54 and 56 axially to axially oscillate shafts 20 and 22, thereby axially oscillating inking rollers 10 and 12.

Figure 5A:
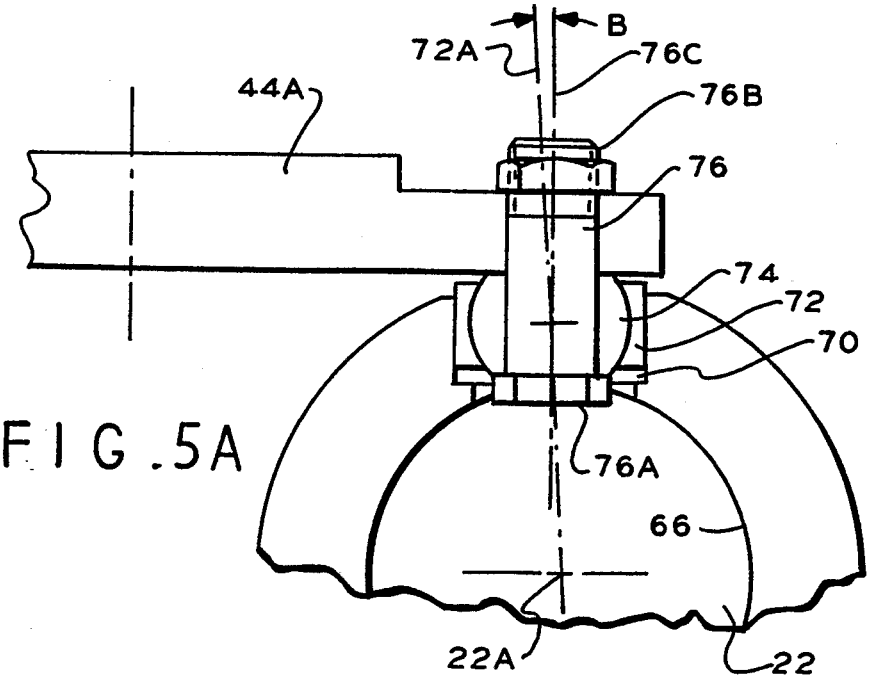
FIG. 5A is a simplified view of the bearing assembly of FIG. 4 with portions broken away for clarity, and showing on a reduced scale the lever arm swung to one extreme.
Figure 5B:
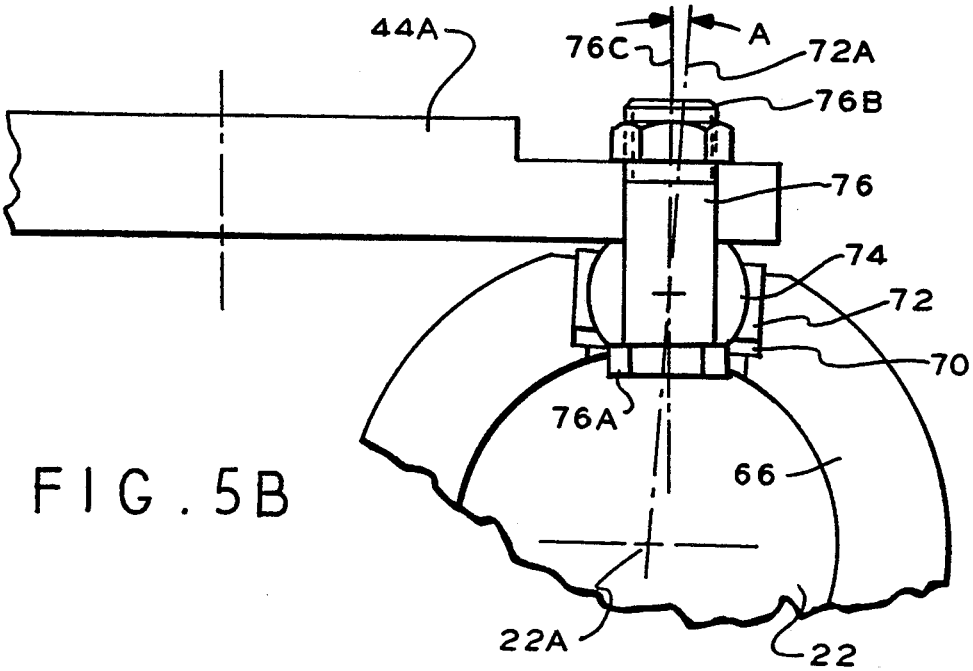
FIG. 5B is a view similar to that of FIG. 5A but with the lever swung to an intermediate position.

Referring to FIG. 5B, arm 44A is shown swung into its intermediate position, that is, at right angles to shaft 22. Thus positioned, arm 44A extends outwardly to the maximum extent (i.e. in a direction past center 22A). Consequently, the center line 76C of stud 76 and member 74 extend to the outside of the center of shaft 22A. This misalignment is accommodated by the angular rotation A between the center line 76C of member 74 and the center line 72A of socket 72. When arm 44A is extended as shown in FIG. 5B socket 72 is shown lifting out of the cylindrical bore 70.

When arm 44A swings from the intermediate position of FIG. 5B, either clockwise or counter clockwise, to an extreme position, the compliant joint changes to the configuration shown in FIG. 5A. In this position, arm 44A retracts from the center 22A of shaft 22. Accordingly, the center line 76C of stud 76 and member 74 move to the inside of center 22A of shaft 22. Consequently, axis 72A of socket 72 shifts as shown to form the angle B with axis 76C.

At positions intermediate those shown in FIGS. 5A and 5B, axis 72A and 76C are aligned with the center 22A of shaft 22. This alignment occurs when the lever 44 has swung to a quarter position (i.e. approximately half way to either extreme position of FIG. 5A from the intermediate position shown in FIG. 5B). In this aligned position, shown in FIG. 3, socket 72 descends to the maximum extent into cylindrical bore 70 in shell 66.

Because of the axial oscillation of inking rollers 10 and 12, the ink is more evenly distributed. Specifically, ghosting is minimized since there is no precise alignment from revolution to revolution of the image being transferred to the blanket cylinder 42 (FIG. 1).

It is to be appreciated that various modifications may be implemented with respect to the above described embodiments. In particular, various printing processes can be employed and either a dry or wet process may be accomplished with the foregoing apparatus. In addition, the printing operation may work on paper, beverage cans, cardboard containers, etc. Also the number of inking rollers and transfer rollers can be different in number than that illustrated herein. Moreover, while two oscillating inking rollers are illustrated, in some embodiments a different number may be employed. Also, the speed of rotation and of axial oscillation can be altered depending upon the nature of a printing process. In addition, in some embodiments one of the inking rollers or transfer rollers can be swung in and out of the system to deposit inks in bands to accommodate the particular image being printed. Also, the illustrated lever can be pivoted at various locations and the cam can be positioned on either side of either oscillating roller. In some embodiments, instead of a cam, the lever that oscillates the inking rollers can be driven by a linear electric motor, hydraulic actuator, a rack and pinion, a crank or other drive means. Also, while the inking rollers are illustrated as being made of steel with the transfer rollers having a compliant surface, in other embodiments different materials of different hardnesses may be used instead. Instead of a compliant joint employing a ball and socket joint, the compliant joint can be a flexible member that would permit flexing in various directions. Moreover, since the universal illustrated herein only uses one rotational degree of freedom, in some embodiments, a simple hinge joint may be used together with a sliding joint similar to that illustrated above. The various illustrated grease fittings can be eliminated or made more numerous depending upon the circumstances. While ball bearings are shown in the bearing assembly having the compliant joint, in other embodiments roller bearings or a journal without rolling elements may be used instead. In addition, the various dimensions and proportions among dimensions may be altered depending upon the items to be printed, the speed of operation, desired rigidity, structural integrity, etc.

Obviously, many modifications and variations of the present invention are possible in light of the above teachings. It is therefore to be understood that within the scope of the appended claims, the invention may be practiced otherwise than as specifically described.

I claim:

1. An oscillating inker mechanism comprising:
a frame;
an inking roller rotatably mounted on said frame with freedom to shift axially at least a predetermined amount;
a bearing assembly connected coaxially to said roller, said bearing assembly having a coaxial outer shell, said inking roller being mounted for rotation independently of said outer shell;
a universal joint having a socket attached to said outer shell and a frustro-spherical member mounted in said socket; and
a pivotally mounted lever connecting to said frustro-spherical member to said universal joint, said lever being operable to swing and to oscillate axially said roller, said universal joint having a degree of freedom to accommodate swinging of said lever; and
drive means for swinging said lever.

2. An inker mechanism according to claim 1 wherein said roller and said lever have axes of rotation that are transverse to each other, said bearing assembly having a spaced pair of bearings mounted within said outer shell.

3. An inker mechanism according to claim 1 wherein said universal joint has means for providing at least one translational degree of freedom permitting variable separation between said lever and said bearing assembly.

4. An inker mechanism according to claim 1 wherein said universal joint has means for providing at least one rotational degree of freedom for angular displacement of said shell with respect to said lever.

5. An inker mechanism according to claim 4 wherein said universal joint means for providing at least one translational degree of freedom permitting variable separation between said lever and said bearing assembly, said socket having a perimeter and being mounted to slide on said perimeter in said outer shell to provide said translational degree of freedom.

6. An inker mechanism according to claim 2 wherein said bearing assembly comprises:
clamp means for pressing said bearings together.

7. An inker mechanism according to claim 6 wherein said universal joint extends at least partially between said pair of bearings.

8. An inker mechanism according to claim 1 wherein said universal joint extends at least partially between said pair of bearings.

9. An inker mechanism according to claim 2 wherein said bearing assembly contains lubricant in an internal space adjoining said socket and said bearings and wherein said socket is slidably mounted in said shell at said internal space to slide into said internal space radially.

10. An inker mechanism according to claim 9 wherein said inking roller comprises:
a pair of cylinders each rotatably mounted on said frame with freedom to shift axially at least a predetermined amount, said lever connecting between said cylinders, said drive means being operable to articulate said lever to oscillate axially said cylinders.

11. An inker mechanism according to claim 10 comprising:
supply means for delivering ink to one of said pair of cylinders; and
at least one transfer roller rotatably mounted between said pair of cylinders for transferring between them ink.

12. An inker mechanism according to claim 11 wherein said supply means comprises:
an ink reservoir; and
a fountain roller communicating with said ink reservoir for carrying from it ink.

13. An inker mechanism according to claim 2 wherein said drive means comprises:
a cam having a sinuous sidewall.

14. An inker mechanism according to claim 1 wherein said inking roller comprises a shaft, said bearing assembly comprising:

a pair of outer bearing races mounted inside said shell;

a pair of inner bearing races mounted inside a different corresponding one of said outer bearing races;

a plurality of rolling elements mounted between each of said inner races and said outer races; and clamp means for holding said inner bearing race on said shaft.

15. An inker mechanism comprising:

a frame;

a pair of inking rollers each having a shaft and each rotatably mounted on said frame with freedom to shift axially at least a predetermined amount;

a pair of bearing assemblies coaxially and separately connected to corresponding ones of said rollers, said inking rollers being mounted for rotation independently of said outer shell, each of said bearing assemblies including:

(a) a coaxial outer shell with a compliant joint, said compliant joint including (i) a socket having a perimeter and being mounted to slide on said perimeter radially in said shell to provide a translational degree of freedom, and (ii) a frusto-spherical member mounted in said socket, (b) a pair of outer bearing races mounted inside said shell, said compliant joint extending at least partially between said pair of outer bearing races, (c) a pair of inner bearing races each mounted inside a different corresponding one of said outer bearing races, (d) a plurality of rolling elements mounted between each of said inner races and said outer races, (e) clamp means for holding said inner bearing races on the shaft, and (f) lubricant contained in an internal space adjoining said socket and said rolling elements and wherein said socket is slidably mounted in said shell to slide into said internal space;

a rotary cam having a sinuous sidewall;

a pivotally mounted lever connecting between said cam and the compliant joint of each of said rollers, said cam being operable to swing said lever to oscillate axially said rollers, said lever having an axis of rotation that is transverse to that of said rollers, said compliant joint having a degree of freedom to accommodate swinging of said lever;

an ink reservoir;

a fountain roller communicating with said ink reservoir for conveying ink toward one of said pair of inking rollers; and at least one transfer roller rotatably mounted between said pair of rollers for transferring between them ink.

* * * * *